US005330327A

United States Patent [19]

Anderson

[11] Patent Number: 5,330,327

[45] Date of Patent: Jul. 19, 1994

[54] TRANSFER TUBE MATERIAL FLOW MANAGEMENT

[75] Inventor: Thomas M. Anderson, Hugo, Minn.

[73] Assignee: Schwing America, Inc., White Bear, Minn.

[21] Appl. No.: 54,073

[22] Filed: Apr. 27, 1993

[51] Int. Cl.[5] ..... F04B 49/00

[52] U.S. Cl. ..... 417/53; 417/279; 417/900; 137/624.13

[58] Field of Search ..... 417/517, 519, 900, 279, 417/53; 137/624.13, 624.15

[56] References Cited

U.S. PATENT DOCUMENTS

| | | | |
|---|---|---|---|
| 1,231,613 | 7/1917 | James | 417/279 |
| 1,980,374 | 11/1934 | Bradshaw | 417/279 |
| 3,650,638 | 3/1972 | Cole . | |
| 3,815,329 | 6/1974 | Pande-Rolfsen | 417/279 |
| 3,836,285 | 9/1974 | Purtell | 417/53 |
| 4,543,044 | 9/1985 | Simmons . | |
| 4,545,736 | 10/1985 | Walton . | |
| 4,611,973 | 9/1986 | Birdwell . | |
| 4,781,066 | 11/1988 | Pope et al. . | |
| 4,790,728 | 12/1988 | Dwyer . | |
| 4,938,054 | 7/1990 | Dye et al. . | |
| 5,106,272 | 4/1992 | Oakley et al. . | |
| 5,144,975 | 9/1992 | Polis | 137/624.13 |

FOREIGN PATENT DOCUMENTS

| | | | |
|---|---|---|---|
| 0097029 | 1/1961 | Netherlands | 417/279 |

*Primary Examiner*—Louis J. Casaregola
*Assistant Examiner*—Michael I. Kocharov
*Attorney, Agent, or Firm*—Kinney & Lange

[57] ABSTRACT

A system for the transport of high solids materials such as concrete includes a positive displacement pump, a pipeline connected to the pump and a valve in the pipeline located downstream from the pump for preventing material flow through the pipeline when the valve is in a closed position. The valve is closed at the end of each pumping stroke to prevent material flow through the pipeline. The pressure of material on the pump side of the valve is sensed. During a subsequent pumping stroke, the valve is opened when sufficient pressure exists on the pump side of the valve to ensure that material will flow in a positive direction through the pipeline.

25 Claims, 6 Drawing Sheets 100
30
14
34
102
104
16
106
108
12
32
66

100
14
32
102
108
104
106
16
12
30

14
32
102
108
100
104
16
106
12
30

100

TRANSFER TUBE MATERIAL FLOW MANAGEMENT

BACKGROUND OF THE INVENTION

The present invention relates to systems for transporting high solids materials such as concrete and sludge. In particular, the present invention relates to a material pump system in which a positive displacement pump, with a pivoting transfer tube valve which connects pump cylinders to the pump outlet, conveys material through a pipeline with a valve located downstream of the pump, and in which the pumping rate and accumulated volume of material pumped are automatically determined.

Positive displacement pumps are frequently used for conveying concrete, sludge and other materials through pipelines in municipal, industrial and construction applications. Positive displacement pumps offer a number of significant advantages over screw or belt conveyors in the pumping of materials. For example, positive displacement pumps are capable of pumping thick, heavy materials which may not be practical for belt or screw conveyors. Pump and pipeline systems also take up less space than screw or belt conveyors and, with the use of simple elbow pipes, are capable of transporting material around corners. Additionally, positive displacement pumps offer a reduction in noise over mechanical conveyors as well as greater cleanliness and reduced spillage.

Various state and federal regulations covering the processing and disposal of sludge require that the processor accurately measure and record the amount of material handled. Similarly, in concrete pumping applications, it is becoming increasingly necessary to accurately measure the quantity of concrete pumped. The pumping of concrete causes considerable wear on the components of the concrete pump and pipeline. Accurate measurement of the quantities of concrete pumped allows the proper maintenance and replacement of components to be scheduled prior to a component failure during use. This prevents unnecessary and costly losses of time due to system failures as well as the inefficient waste of concrete which may become unusable as a result of the delays associated with the failure of a pump or pipeline component.

Positive displacement material pumps such as those described in Oakley et al., U.S. Pat. No. 5,106,272, entitled "SLUDGE FLOW MEASURING SYSTEM", can accurately measure the volume of material transported. Oakley et al. discloses a system for transporting high solids sludge which includes a positive displacement pump for pumping sludge through a pipeline. The volume of sludge transported is accurately measured by determining the fill percentage of the pumping cylinder during each pumping cycle. The fill percentage is determined by using any of a number of sensed parameters including material flow signals, measured time intervals, hydraulic fluid pressure, and hydraulic fluid flow rate during each pumping cycle.

One embodiment of the system and pump disclosed in Oakley et al. includes a valve, commonly referred to as a poppet valve, between the pumping cylinder and the outlet which opens and connects the pumping cylinder to the outlet only when the pressure within the pumping cylinder essentially equals the pressure at the outlet. The timing of the opening of the outlet poppet valve during the outlet stroke provides a means for determining the fill percentage or the total volume delivered during each pumping stroke.

Oakley et al. also discloses another embodiment of the system in which the pump includes an outlet valve, commonly referred to as a pivoting transfer tube valve, which connects the outlet to the pumping cylinder during the entire pumping stroke. In this embodiment, both the hydraulic pressure driving the piston and the outlet pressure are sensed during the pumping stroke. Determining either the time or the piston position in the pumping stroke when the hydraulic pressure equals the outlet pressure can be used to derive a fill percentage or volume delivered during each pumping stroke.

When pumping concrete or other material with large particles, material pumps frequently employ pivoting transfer tube valves, like those disclosed in Oakley et al., to control the intake and outlet of material to and from the pump cylinders. Pivoting transfer tubes switch hydraulically to connect the pump cylinders to either a material intake or a material outlet of the pump. In a two-cylinder material pump, the transfer tube switches hydraulically to serve both pumping cylinders. The transfer tube is mounted in an open-topped housing or hopper which accepts the material to be pumped. The transfer tube pivots to connect the pumping cylinder to the pump outlet and pipeline, while allowing the cylinder which is intaking material to pump material from the hopper into the cylinder.

Pivoting transfer tubes have several advantages over other valve types. First, as the transfer tube switches, large particles which could interfere with the pump performance are moved or sheared. Second, the transfer tube's large diameter allows it to accept larger particles than other types of valves. Finally, transfer tubes have automatic adjustment capability and low maintenance requirements as well as a wear-life unaffected by pumping pressures.

In a typical application, a concrete pump with a pivoting transfer tube valve may be used to pump concrete for construction of a high-rise building. In such applications, the pump is frequently connected to a long pipeline which carries the concrete to its destination. After completion of a pumping stroke in one cylinder, as the transfer tube switches to connect another cylinder to the pump outlet, the material in the pipeline exerts extreme pressure back towards the hopper. In addition to working against the concrete pump's purpose of pumping concrete through the pipeline, this can create an extremely dangerous condition as the concrete is forced back through the pipeline toward the pump.

SUMMARY OF THE INVENTION

The present invention is based upon the recognition that a positive displacement pump with an outlet valve that connects a pump cylinder to the outlet during the entire duration of each pumping stroke, together with a pipeline valve which prevents pumped material in the pipeline from flowing back toward the positive displacement pump when the outlet valve switches to connect a second pump cylinder to the outlet, offers better performance, increased safety, and the capability of accurate volume and flow rate measurement. Accurate volume and flow rate measurement is achieved by closing the pipeline valve at the end of each pumping stroke to prevent concrete from flowing back towards the pump, and opening the pipeline valve only when sufficient pressure exists on the pump side of the valve to ensure that material will flow in a positive direction through the pipeline.

The pump system of the present invention includes a positive displacement piston/cylinder material pump for pumping material through a pump outlet during each pumping stroke. A pipeline is connected to the pump outlet for receiving material from the pump. A valve is located in the pipeline downstream from the pump for preventing material flow through the pipeline when the valve is in a closed position. The valve is closed at the end of a first pumping stroke. The pressure of the material on the pump side of the valve is sensed. When it is determined that, during a second pumping stroke, the sensed pressure on the pump side of the valve is sufficient to ensure that material will flow in a positive direction through the pipeline, a first signal is provided. When the first signal is provided, the valve is opened to allow material flow through the pipeline.

In one preferred embodiment of the present invention, determining when the pressure on the pump side of the valve is sufficient involves storing a first pressure value representative of the pressure on the pump side of the valve at the end of the first pumping stroke. The sensed pressure on the pump side of the valve during the second pumping stroke is compared to the first pressure value. The first signal is provided when the sensed pressure on the pump side of the valve during the second pumping stroke obtains a predetermined relationship to the stored first pressure value.

In a second preferred embodiment, determining whether the pressure on the pump side of the valve is sufficient to ensure that material will flow in a positive direction through the pipeline includes sensing the pressure of the material on the downstream side of the valve during the second pumping stroke. The sensed pressure on the pump side of the valve during the second pumping stroke is compared to the sensed pressure on the downstream side of the valve during the second pumping stroke. The first signal is provided when the sensed pressure on the pump side of valve during the second pumping stroke obtains a predetermined relationship to the sensed pressure on the downstream side of the valve during the second pumping stroke.

In preferred embodiments of the present invention, the time during the second pumping stroke that the valve is opened to allow material to flow through the pipeline is used to calculate a fill percentage or actual volume pumped during each pumping stroke. A computer records the times (or piston positions) that each pumping stroke begins and ends. The time (or distance traveled) during each pumping stroke after the valve opens, divided by the total time (or total distance traveled) of the pumping stroke represents the fill percentage or actual volume pumped during that pumping stroke.

With the present invention, accurate measurement of instantaneous pumping rate, accumulated volume pumped, and pump efficiency is possible for high solids materials such as concrete. Additionally, the present invention allows the high solids materials to be pumped through a pipeline with increased safety and pump efficiency.

DETAILED DESCRIPTION OF THE PREFERRED EMBODIMENTS

A. OVERVIEW OF PUMP 10

Figure 1:
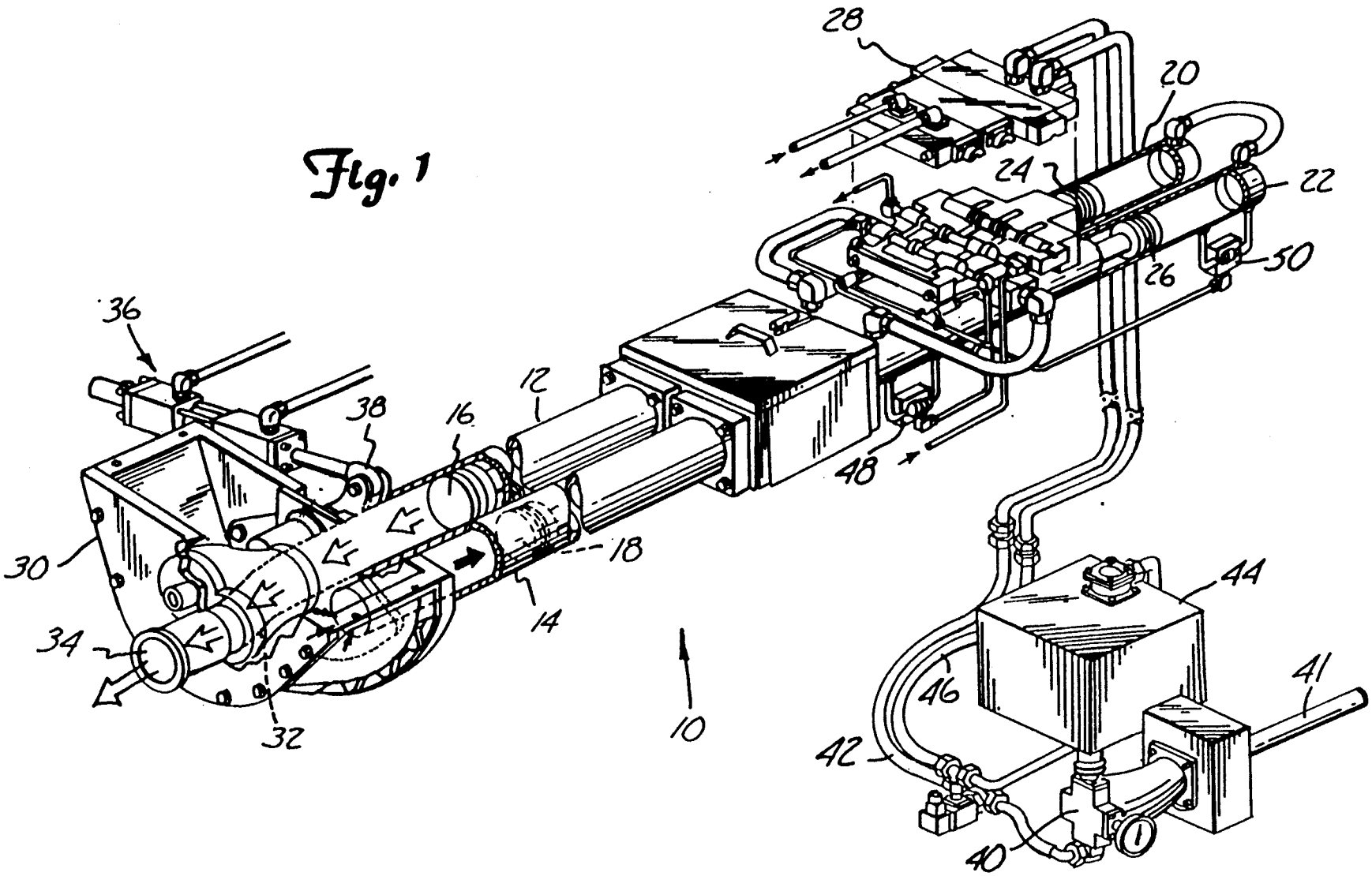
FIG. 1 is a perspective view, with portions broken away and portions exploded, of a concrete pump.

FIG. 1 shows a two-cylinder, hydraulically-driven, positive displacement material pump 10. Pump 10 includes material cylinders 12 and 14, material pistons 16 and 18, hydraulic drive cylinders 20 and 22, drive pistons 24 and 26, valve assembly 28, hopper 30, pivoting transfer tube 32, outlet 34, hydraulic actuators 36, pivot arm 38, hydraulic pump 40, input shaft 41, high pressure lines 42, hydraulic reservoir 44, low pressure lines 46, and forward and rear switching valves 48 and 50. Material pistons 16 and 18 reciprocate in material cylinders 12 and 14. Hydraulic drive cylinders 20 and 22 contain drive pistons 24 and 26, which are connected to material pistons 16 and 18, respectively. Valve assembly 28 controls the sequencing of movement of pistons 24 and 26, and thus the movement of pistons 16 and 18 in material cylinders 12 and 14.

Cement or other material is supplied to hopper 30, in which pivoting transfer tube 32 is positioned. It should be noted that pivoting transfer tube 32 represents only one type of material valve, and that other types can be used with the present invention as well. Transfer tube 32 connects outlet 34 with one of the two material cylinders (in FIG. 1, outlet 34 is connected to cylinder 12), while the inlet to the other material cylinder (in this case, cylinder 14) is opened to the interior of hopper 30. In FIG. 1, piston 16 is moving forward in a discharge stroke to pump concrete out of cylinder 12 to outlet 34, while piston 18 is moving rearward to draw concrete into cylinder 14.

At the end of the stroke, hydraulic actuators 36 which are connected to pivot arm 38 cause transfer tube 32 to swing so that outlet 34 is now connected to cylinder 14. Then, the direction of movement of pistons 16 and 18 reverses, with piston 18 now moving forward in a discharge stroke while piston 16 now moves backward in a filling or loading stroke.

Hydraulic fluid is pumped from hydraulic pump 40, which is driven by input shaft 41, through high pressure lines 42 to control valve assembly 28. Valve assembly 28 includes check valves which control the sequencing of high and low pressure hydraulic fluid to hydraulic cylinders 20 and 22 and to hydraulic actuators 36 in a known manner. Low pressure hydraulic fluid returns to hydraulic reservoir 44 through low pressure line 46 from valve assembly 28.

Forward and rear switching valves 48 and 50 sense the position of piston 26 at the forward and rear ends of travel and are interconnected to control valve assembly 28. Each time piston 26 reaches the forward or rear end of its travel in cylinder 22, a valve sequence is initiated which results in transfer tube 32 swinging so that outlet 34 is connected to the other material cylinder 12 or 14 which has just completed a filling stroke. The valve sequence also results in a reversal of the high pressure and low pressure connections to cylinders 20 and 22.

The sequence of operations of pump 10 is generally as follows. As drive pistons 24 and 26 come to the end of their stroke, one material cylinder (in FIG. 1, cylinder 12) is discharging concrete to outlet 34, while the other material cylinder (cylinder 14) is loading concrete through its inlet from hopper 30. At the end of the pumping stroke, material piston 16 is at its closet point to outlet 34, while piston 18 is at its position furthest from outlet 34. At this point, switching valve 50 senses that hydraulic drive piston 26 has reached the rearward end of its stroke. Valve assembly 28 and hydraulic actuators 36 are activated which causes transfer tube 32 to swing so that outlet 34 is now connected to cylinder 14 instead of cylinder 16. The operation continues with one material piston 14 or 16 operating in a filling stroke, while the other is operating in a pumping or discharge stroke.

B. TRUCK MOUNTED CONCRETE PUMP SYSTEM 60

Figure 2:
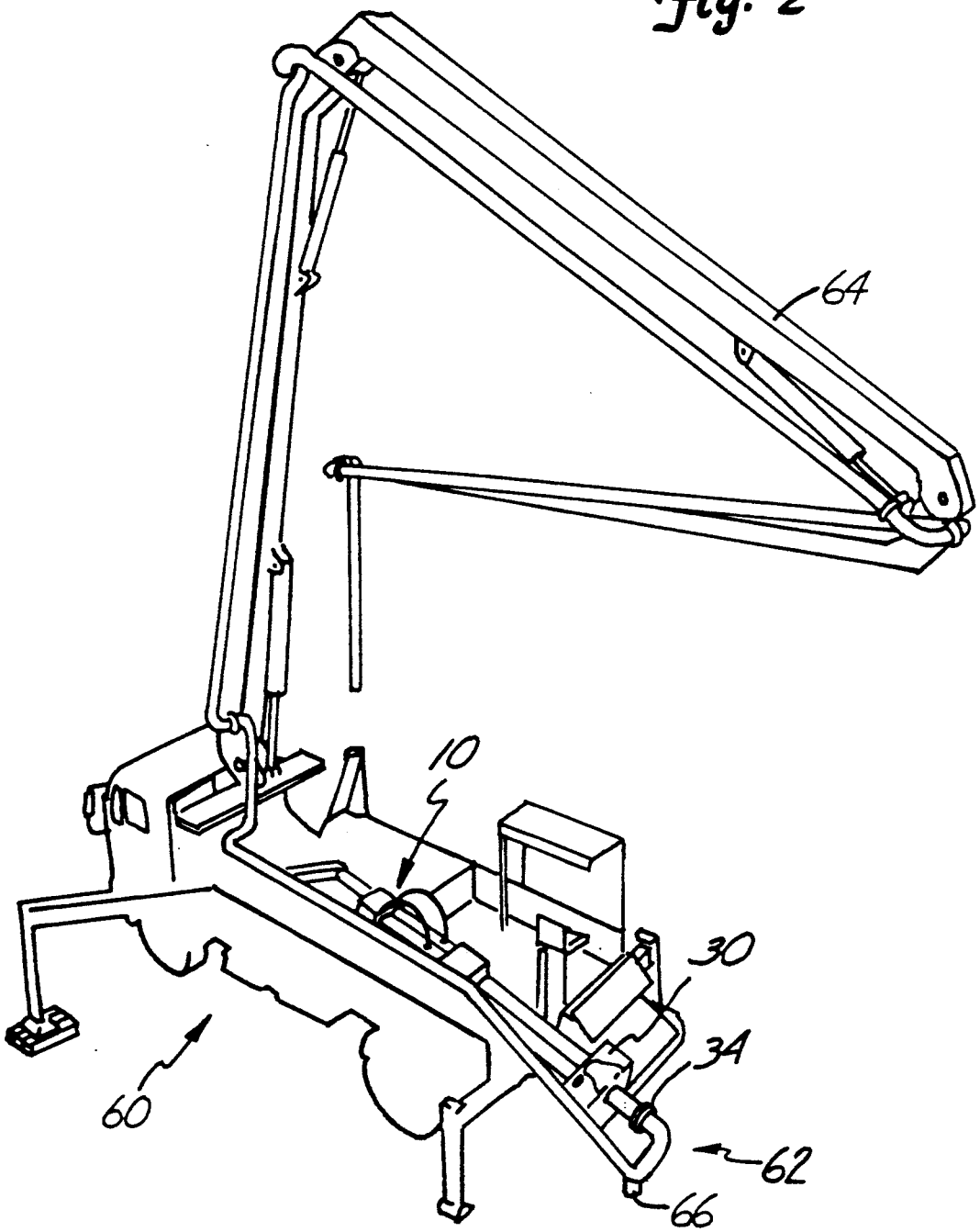
FIG. 2 is a perspective view of a truck mounted concrete pump and pipeline system in accordance with the present invention.

FIG. 2 shows a perspective view of truck mounted concrete pump system 60. Pump system 60 includes two-cylinder material pump 10, pipeline 62, placing boom 64, and plug valve assembly 66. Outlet 34 of pump 10 is connected to pipeline 62. Material pump 10 functions as described above to pump concrete from hopper 30 through outlet 34 to pipeline 62.

Pipeline 62 is connected to placing boom 64 for pumping concrete to difficult to reach locations. To pump material through pipeline 62, pump 10 must create pumping pressures which exceed the pressure of the concrete in pipeline 62. The pressure of the concrete in pipeline 62 is dependant upon factors such as total pipeline length, vertical distance the concrete is pumped, and the type of concrete being pumped. The pumped material in pipeline 62 exerts extreme pressures back towards pump 10.

At the end of each pumping stroke, transfer tube 32 swings to connect a different material cylinder (either 12 or 14) to outlet 34. During the time that transfer tube 32 swings between material cylinders, and during the time that the second material piston (either 16 or 18) has begun its pumping stroke but before the pressure of the concrete in the second material cylinder has exceeded the pressure in pipeline 62, material in pipeline 62 will flow backwards towards pump 10. This can create an extremely dangerous situation. It also makes accurate measurements of total concrete pumped difficult to calculate.

Plug valve assembly 66, which in preferred embodiments is hydraulically connected to the operation of pump 10, is closed at the end of every pumping stroke to prevent the flow of concrete in a negative direction, back through pipeline 62 towards pump 10. This feature greatly reduces the danger of concrete flowing back toward pump 10 while transfer tube 32 switches to connect a differential material cylinder to outlet 34. However, if plug valve assembly 66 is opened at the start of each pumping stroke, before pumping pressures are sufficient to prevent concrete from flowing backwards towards pump 10, accurate measurement of concrete pumped will be difficult because concrete will flow backwards towards pump 10 during this portion of each pumping stroke.

C. PUMP AND PIPELINE SYSTEM 100

Figure 3:
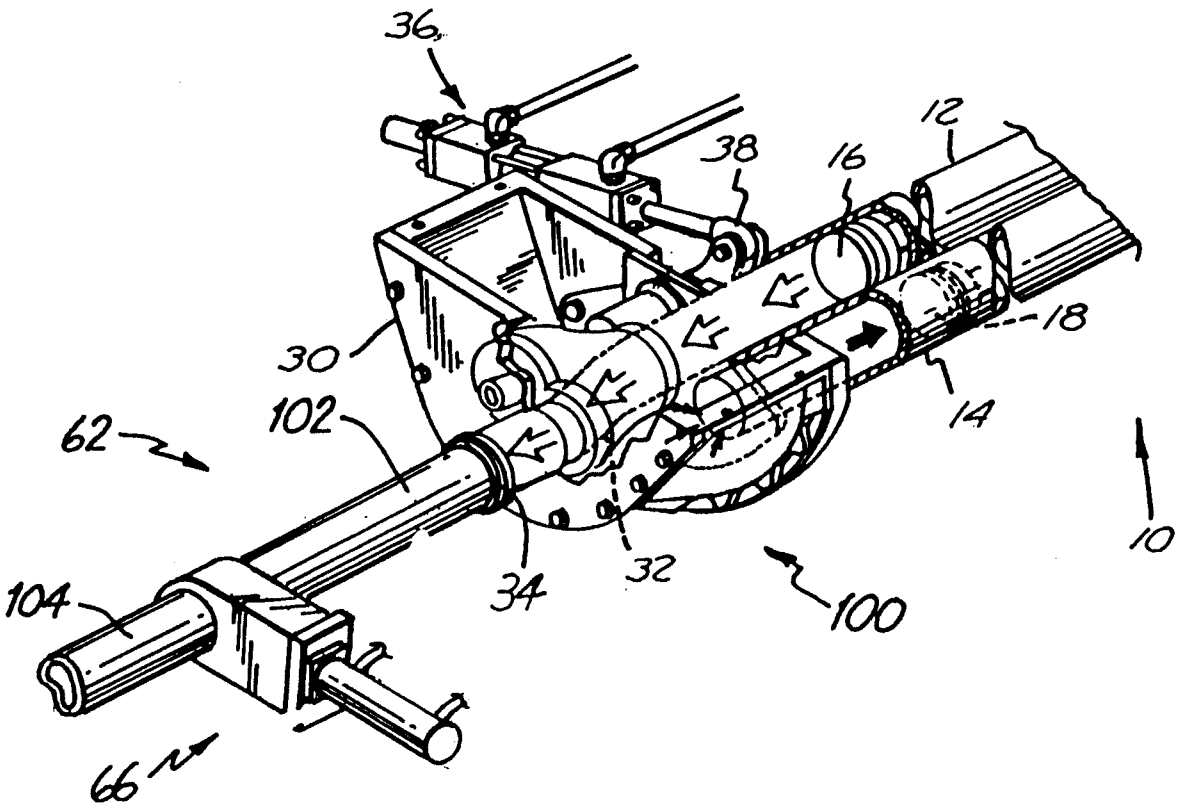
FIG. 3 is a perspective view, with portions broken away, of part of the concrete pump and pipeline system of the present invention.

FIG. 3 is a perspective view of pump and pipeline system 100 in accordance with preferred embodiments of the present invention. Pump and pipeline system 100 includes pump 10, pipeline 62 and plug valve assembly 66. FIG. 3 shows portions of pump 10 and pipeline 62, while illustrating plug valve assembly 66 in more detail. Pipeline 62 includes first and second pipe sections 102 and 104, with plug valve assembly 66 connected between pipe sections 102 and 104.

As material piston 16 pumps concrete from cylinder 12 into pipeline 62 during its pumping stroke, material piston 18 draws material from hopper 30 into cylinder 14 during its filling stroke. At or near the end of the pumping stroke of piston 16, valve assembly 66 closes to prevent material flow between first and second pipe sections 102 and 104. Also, at the end of the pumping stroke, hydraulic actuators 36, which are connected to pivot arm 38, cause transfer tube 32 to swing so that outlet 34 is now connected to cylinder 14. During the time that transfer tube 32 swings between cylinders 12 and 14, and during the time that piston 18 builds up sufficient pressure in cylinder 14 to overcome the pressure of concrete in pipeline 62, valve assembly 66 prevents concrete in pipeline 62 from flowing in a negative direction, towards pump 10. When the pressure in cylinder 14 and pipe section 102 exceeds some predetermined value, valve assembly 66 opens to allow the concrete in cylinder 14 to be pumped through first and second pipe sections 102 and 104 of pipeline 62. At the end of the pumping stroke of piston 18, valve assembly 66 once again closes as pivoting transfer tube 32 swings to connect cylinder 12 to outlet 34 and pipeline 62. This process continues repeatedly during each pumping stroke.

FIGS. 4–7 are sectional views, with portions shown in full, illustrating the operation of pump and pipeline system 100 in greater detail. FIGS. 4–7 show material cylinders 12 and 14, material pistons 16 and 18, hopper 30, pivoting transfer tube 32, and outlet 34 of pump 10, as well as pipe sections 102 and 104 of pipeline 62, and housing 106 and valve 108 of plug valve assembly 66.

Figures 4, 5, 6:
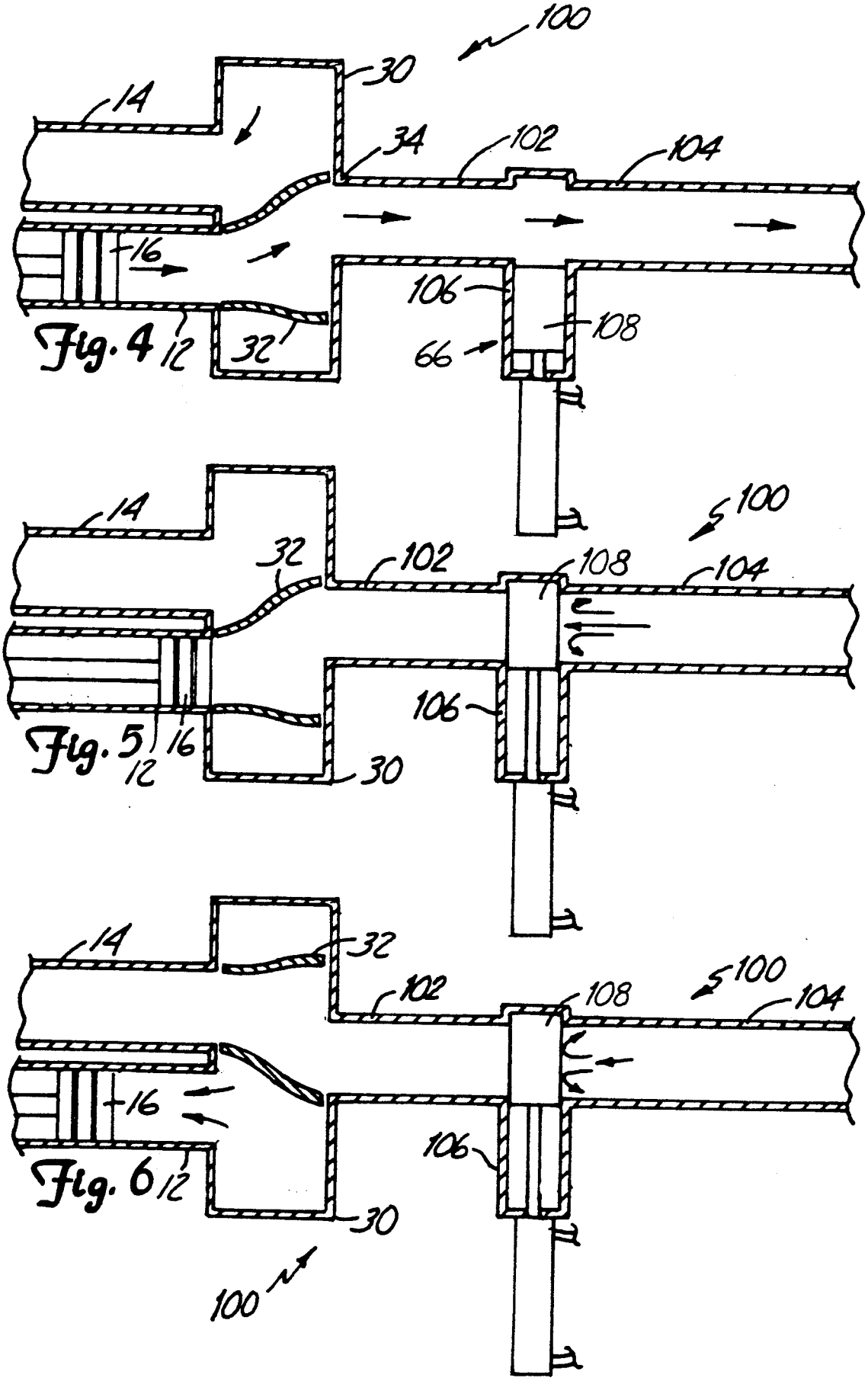
FIGS. 4–7 are partial sectional views illustrating an operating sequence of the pump and pipeline system of FIG. 3.

In FIG. 4, piston 16 is shown pumping concrete from cylinder 12, through transfer tube 32 and outlet 34, to pipe section 102. Plug valve assembly 66 is in an open position, with valve 108 recessed into housing 106 to allow concrete to flow through pipe sections 102 and 104 in a positive direction, away from pump 10. At the same time, piston 18 is drawing concrete from hopper 30 into cylinder 14 during its filling stroke.

As shown in FIG. 5, when material piston 16 reaches the end of its pumping stroke, valve assembly 66 is closed so that valve 108 blocks the flow of concrete between pipe sections 102 and 104. Concrete in pipe section 104 exerts pressure on valve 108, but is prevented from flowing in a negative direction toward pump 10.

In FIG. 6, transfer tube 32 has swung to connect cylinder 14 to outlet 34, while the inlet of cylinder 12 is opened to hopper 30. During the pumping stroke of piston 18, concrete in cylinder 14 is forced towards transfer tube 32 and outlet 34, removing voids in the concrete. Initially, the concrete pressure in cylinder 14 and pipe section 102 is considerably less than the concrete pressure in pipe section 104. Therefore, valve 108 is needed to prevent concrete in pipe section 104 from flowing in a negative direction, towards pump 10. As piston 18 removes voids from the concrete in cylinder 14, the pressure of the concrete in cylinder 14 and pipe section 102 increases.

Figure 7:
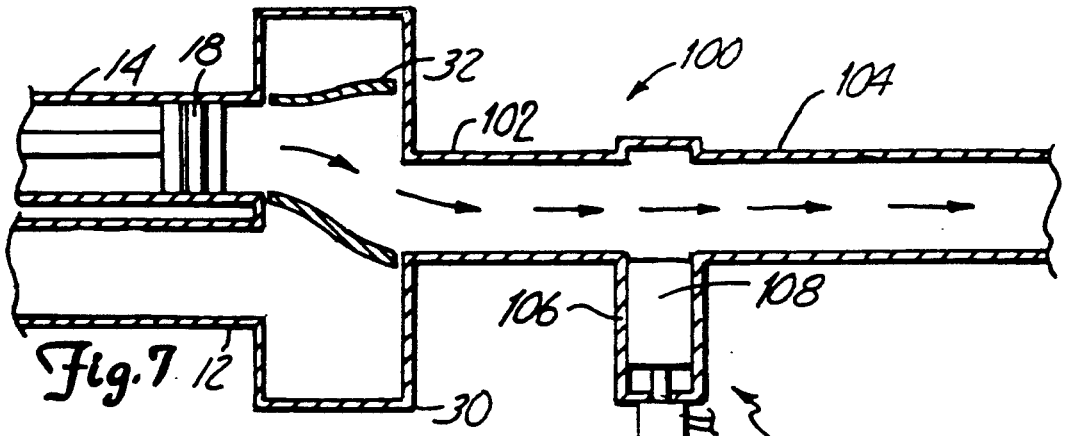

FIG. 7 shows pump and pipeline system 100 with piston 18 further along in its pumping stroke. When the pressure in cylinder 14 and pipe section 102 increased to the point that it was sufficient to ensure that concrete would flow in a positive direction from pipe section 102 to pipe section 104, valve assembly 66 was moved to an open position, with valve 108 once again recessed into housing 106. After valve assembly 66 opens, piston 18 pumps concrete through pipe sections 102 and 104 in a positive direction for the duration of its pumping stroke. At the end of the pumping stroke of piston 18, valve assembly 66 once again closes while transfer tube 32 swings to connect cylinder 12 to outlet 34 and pipeline 62.

D. PUMP AND PIPELINE SYSTEM 200

Figure 8:
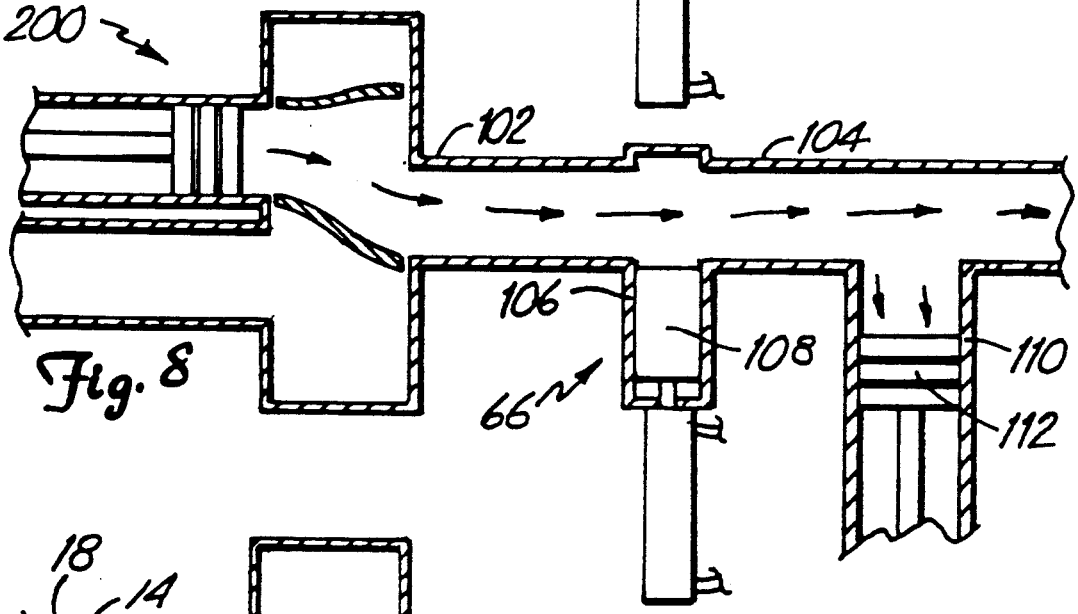
FIGS. 8 and 9 are partial sectional views illustrating an operating sequence of a second embodiment of the present invention.
Figure 9:
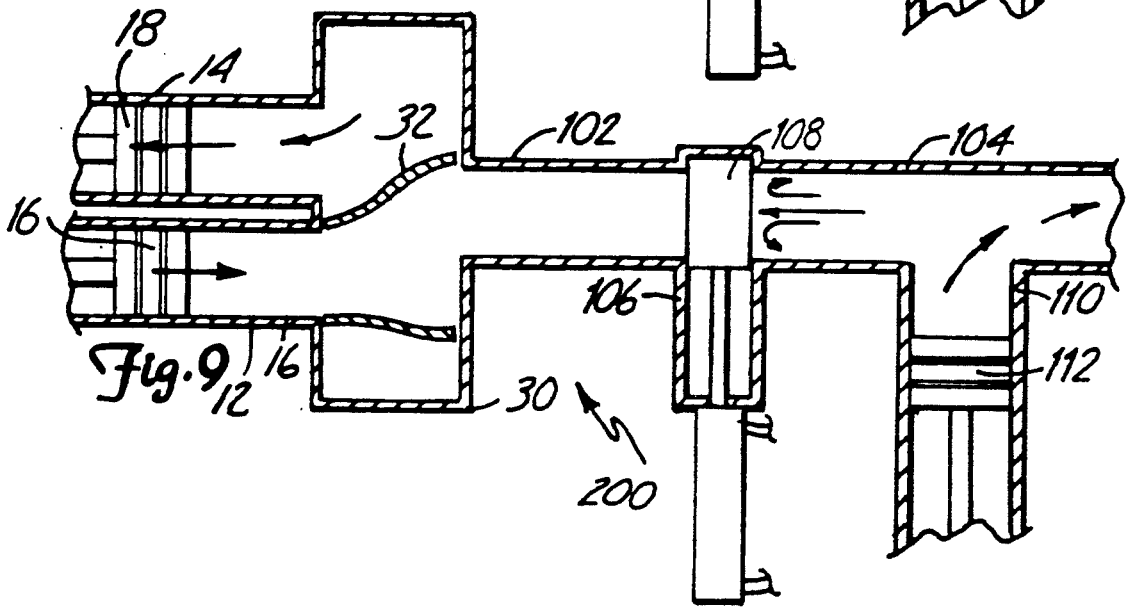

FIGS. 8 and 9 are sectional views, with portions shown in full, of second pump and pipeline system 200, also in accordance with the present invention. Like system 100, pump and pipeline system 200 includes pump 10, first and second pipe sections 102 and 104 of pipeline 62, and housing 106 and valve 108 of plug valve assembly 66. However, system 200 also includes concrete storage cylinder 110 and concrete storage piston 112. Cylinder 110 is connected to pipe section 104, downstream of pump 10 and valve assembly 66.

As shown in FIG. 8, with valve assembly 66 in an open position, piston 18 is pumping concrete through pipe sections 102 and 104 during its pumping stroke. During this portion of the pumping stroke of piston 18, piston 112 is moving rearward to draw concrete into cylinder 110 from pipe section 104 during its filling stroke. As a result, a portion of the concrete pumped by piston 18 during its pumping stroke is diverted from the main flow of concrete through pipe section 104 into cylinder 110.

Piston 112, which in preferred embodiments is hydraulically driven, can be controlled so that, during its filling stroke, it moves at a constant velocity. Therefore, the rate that piston 112 draws concrete into cylinder 110 can be maintained constant. If the rate of concrete flow between pipe sections 102 and 104 is also maintained constant during the portion of each pumping stroke that valve assembly 66 is open, this will result in a constant flow of concrete in pipe section 104 downstream of cylinder 110 and piston 112 during the period of time that valve assembly 66 is in an open position.

In FIG. 9, piston 18 has completed its pumping stroke, while piston 16 has completed its filling stroke. Valve 108 closed at the end of the piston 18 pumping stroke to prevent concrete from flowing in a negative direction towards pump 10 while transfer tube 32 swung, and while piston 16 builds sufficient pressure in cylinder 12 and pipe section 102, during its pumping stroke, to prevent concrete in pipeline 62 from flowing in a negative direction. When valve 108 closed, piston 112 began a pumping stroke, pumping concrete from cylinder 110 into pipe section 104. Therefore, the flow of concrete through the downstream portion of pipe section 104 remains uninterrupted. By controlling the velocity of piston 112, the flow of concrete from cylinder 110 ensures that the flow of concrete in a positive direction through pipe section 104 remains constant, even during the period that valve 108 blocks concrete flow between pipe sections 102 and 104.

E. MONITOR SYSTEM 300

Figure 10:
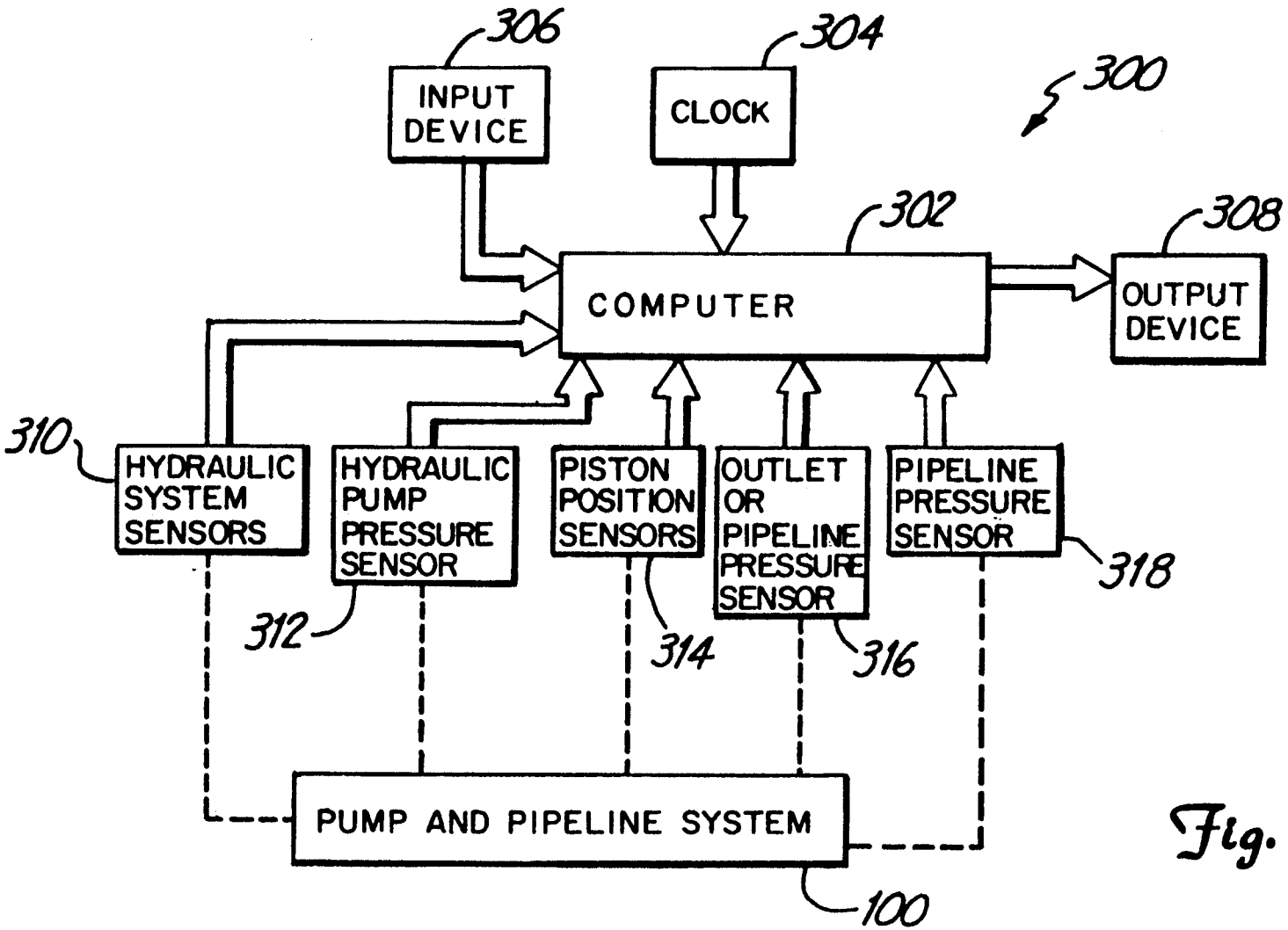
FIG. 10 is a block diagram of pump and pipeline monitoring system of the present invention.

FIG. 10 shows a preferred embodiment of the present invention in which operation of pump and pipeline system 100 is monitored by system 300. Monitor system 300 can be used to monitor pump and pipeline system 200 in the same way that it monitors system 100, and therefore, our discussion is limited to the monitoring of system 100. Monitor system 300 includes computer 302, which in a preferred embodiment is a microprocessor-based computer including associated memory and associated input/output circuitry. Monitor system 300 also includes clock 304, input device 306, output device 308, and pump sensors 310–318 which will be described later in greater detailed.

In other embodiments of the present invention, monitor system 300 includes a programmable logic controller (PLC) instead of computer 302.

Clock 304 provides a time base for computer 302. Although shown separately in FIG. 10, clock 304 is, in preferred embodiments of the present invention, contained as part of computer 302.

Input device 306 is preferably any of a number of devices. In one preferred embodiment, input device 306 is a keypad entry device. Input device 306 can also be a keyboard, a remote program device or any other suitable mechanism for providing information to computer 302.

Output device 308 can also take a variety of forms. For example, output device 308 can include a display output such as a cathode ray tube or liquid crystal display. Output device 308 can also be a printer, or a communication device such as a cellular phone which transmits the output of computer 302 to another computer based system (which may monitor the overall operation in which pump and pipeline assembly 100 is being used).

Sensors 310–318 monitor the operation of pump and pipeline system 100 and provide signals, representative of pump and pipeline operation, to computer 302. The parameters sensed by sensors 310-318 provide various indications of pump operation and performance, and provide computer 302 with information needed to monitor the performance and control certain operational aspects of system 100. It should be understood that monitor system 300 may include some or all of sensors 310–318. Some of sensors 310–318 provide computer 302 with duplicative information and could therefore, in other embodiments, be omitted from monitor system 300.

Hydraulic system sensors 310 provide an indication to computer 302 of the start and stop of each pumping stroke in pump 10. Sensors 310 may also provide information to computer 302 on other hydraulically controlled functions of system 100 such as the operation of valve 108 of plug valve assembly 66, and the position and operation of transfer tube 32 which swings to connect a different material cylinder 12 or 14 to outlet 34 at the completion of each pumping stroke.

Hydraulic pump pressure sensors 312 sense the pressure of the hydraulic fluid on the high pressure side of pump 10. This information is indicative of the concrete pressure in the pumping cylinder as well. In addition to supplying computer 302 with hydraulic pressure information, hydraulic pressure signals from sensors 312 are preferably monitored to obtain other information such as the start and stop times of each pumping stroke.

Piston position sensors 314 sense the position of each of the pistons of pump 10 during pumping strokes. From the signals supplied by piston position sensors 314, the starting and stopping points of each pumping stroke are also known. The signals from piston position sensors 314 are, in a preferred embodiment, a digital value. For example, piston position sensors 314 are preferably linear displacement sensors (which may be analog sensors), coupled to an analog-to-digital convertor so that the data supplied to computer 302 is in a digital form.

Outlet or pipeline pressure sensor 316 is preferably an analog pressure sensor or a digital pressure sensor located in outlet 34 or pipe section 102 of pipeline 62. Sensor 316 provides computer 302 with information on concrete pressure in outlet 34 and pipeline section 102. Pressure sensor 316, as will be discussed later in greater detail, provides computer 302 with signals which, in conjunction with signals from sensors 312, 314 and 318, are indicative of a pump efficiency or fill percentage.

Pipeline pressure sensor 318 is also preferably an analog pressure sensor or a digital pressure sensor, located in pipe section 104 of pipeline 62. Sensor 318 provides computer 302 with information indicative of concrete pressure in pipe section 104.

F. CONTROL OF PLUG VALVE ASSEMBLY 66

In preferred embodiments of the present invention, monitor system 300 is used to control certain operational aspects of pump and pipeline system 100. In particular, monitor system 300 can be used to control the hydraulic operation of plug valve assembly 66. However, it should be noted that valve assembly 66 could also be controlled with hydraulic logic, as is the case with control of other operational aspects of pump 10.

In a first embodiment of the present invention, computer 302 monitors signals from sensor 312 or sensor 316 to obtain information relating to the pressure of concrete in the pumping cylinder (either 12 or 14) and in pipe section 102 of pipeline 62. At the end of each pumping stroke, computer 302 records the concrete pressure that is present immediately before valve assembly 66 closes. Then, during a second pumping stroke, computer 302 once again monitors signals from sensors 312 or 316, which are now representative of the concrete pressure in the pumping cylinder and in pipe section 102 with valve 108 blocking the flow of concrete. When the concrete pressure in the pumping cylinder and in pipe section 102 during the second pumping stroke obtains a predetermined relationship to the pressure recorded during the previous pumping stroke before valve assembly 66 closed, computer 302 generates a signal which causes valve assembly 66 to open, once again allowing concrete to flow between pipe sections 102 and 104. The predetermined relationship is dependent upon the pressure needed on the pump side of valve assembly 66 to ensure the flow of concrete through pipeline 62 will be in a positive direction, away from pump 10.

In a second embodiment of the present invention, computer 302 does not compare the concrete pressure on the pump side of valve assembly 66 during consecutive pumping strokes, but instead, monitors the concrete pressure on both the pump side and the downstream side of valve assembly 66 during the second pumping stroke while valve assembly 66 is still in a closed position. In this embodiment, with plug valve assembly 66 in a closed position to block the flow of concrete between pipe sections 102 and 104, computer 302 monitors signals from either sensor 312 or sensor 316, both of which are representative of the pressure on the pump side of valve assembly 66. At the same time, computer 302 monitors signals from pipeline pressure sensor 318, which is located in pipe section 104 downstream from valve assembly 66. When the pressure on the pump side of pipeline 62 exceeds the pressure on the downstream side of pipeline 62, computer 302 generates a signal which causes valve assembly 66 to move to an open position, once again allowing concrete to flow in a positive direction through pipe sections 102 and 104.

G. ACTUAL VOLUME AND PERCENTAGE FILL

In preferred embodiments of the present invention, computer 302 calculates, for each pumping stroke, a pump efficiency rating or fill percentage. Depending upon the pumpability of the concrete being used, cylinders 12 and 14 will not likely be totally filled with concrete during a loading stroke. Knowing the total displacement volume of cylinders 12 and 14, and knowing the fill percentage of the cylinders during each stroke, computer 302 can calculate an actual volume pumped during any given stroke and an accumulated actual volume pumped during a number of pumping strokes.

The percentage fill can be determined as follows. As discussed previously, computer 302 receives signals from hydraulic system sensors 310, hydraulic pump pressure sensor 312, or piston position sensors 314 which are indicative of the beginning of each pumping stroke. As pistons 16 and 18 travel through cylinders 12 and 14 during their respective pumping strokes, concrete in the cylinders is compacted. When the concrete in a cylinder is near fully compacted, the pressure in that cylinder increases as piston 16 or 18 moves forward within that cylinder. Using one of the methods described above, computer 302 determines when, during a pumping stroke, concrete pressures in the pumping cylinder and in pipe section 102 are sufficient to ensure that concrete will flow in a positive direction through pipe sections 102 and 104. As discussed above, when sufficient pressures exist, valve assembly 66 opens to allow concrete flow through pipe sections 102 and 104 in a positive direction.

The time, during each pumping stroke, that valve assembly 66 is open is representative of the time that the piston (16 or 18) has built up sufficient pressure to push concrete out of the cylinder, through outlet 34, to pipeline 62. Therefore, computer 302 records the time (or, in the alternative, the piston position) during the pumping stroke when valve assembly 66 opens. Computer 302 next receives a signal from sensors 310, sensor 312 or sensor 314 which indicates that the pumping stroke is completed. Computer 302 next determines an efficiency rating or fill percentage by dividing the pumping stroke time (or distance traveled) after valve assembly 66 opens by the total pumping stroke time (or total distance traveled).

In other preferred embodiments, system 300 includes sensors which provide computer 302 with information necessary to determine whether the velocity of pistons 16 and 18 remained essentially constant through the entire pumping stroke. In these embodiments, if computer 302 determines that the velocity did not remain essentially constant, adjustments are made to the calculated fill percentage, because this method of calculating fill percentage is actually based upon the ratio of the length of the stroke after valve assembly 66 opens to the total stroke length. The fill percentage for each stroke is stored in a register within the memory of computer 302. Since the total displacement volume of material cylinders 12 and 14 is known, computer 302 can, using the calculated fill percentage, determine an actual volume pumped during each stroke. In addition, computer 302 updates a register which keeps an accumulated total of actual volume pumped.

Using input signals from clock 104, computer 302 can determine the length of time of each pumping stroke and an accumulative length of time during which the accumulated total actual volume was pumped. With this information, computer 302 calculates an instantaneous pumping rate for each cycle, as well as an average pumping rate over an accumulated time.

H. CONCLUSION

The present invention is based upon the recognition that a pump and pipeline system, together with a valve in the pipeline which closes to prevent concrete or other material from flowing backwards through the pipeline when insufficient pumping pressures exist on the pump side of the valve, offers increased performance, increased safety, and the capability of accurate volume and flow rate measurement.

In one embodiment of the present invention, the concrete pressure on the pump side of plug valve 66 is monitored. Computer 302 stores a first pressure value which is dependant upon the sensed pressure of the material on the pump side of valve assembly 66 at the end of the first pumping stroke. Valve assembly 66 is then closed to prevent concrete flow between first and second outlet pipe sections 102 and 104. Next, computer 302 monitors the concrete pressure on the pump side of valve assembly 66 during a second pumping stroke. When the concrete pressure on the pump side of valve assembly 66 during the second pumping stroke obtains a predetermined relationship to the first pressure value, plug valve assembly 66 is opened to allow concrete flow between pipe sections 102 and 104 during the remainder of the second pumping stroke.

In a second preferred embodiment, plug valve assembly 66 closes at the end of each pumping stroke. During a second pumping stroke, computer 302 monitors both the concrete pressure on the pump side of valve assembly 66 and the concrete pressure on the downstream side of valve assembly 66. When the concrete pressure on the pump side of valve assembly 66 obtains a predetermined relationship to the concrete pressure on the downstream side of valve assembly 66, valve assembly 66 is opened to allow concrete flow between pipe sections 102 and 104 during the remainder of the second pumping stroke.

Although the present invention has been described with reference to preferred embodiments, workers skilled in the art will recognize that changes may be made in form and detail without departing from the spirit and scope of the invention. For example, the present invention is applicable to high solids materials other than concrete.

What is claimed is:

1. A method of controlling the operation of a positive displacement piston/cylinder material pump and pipeline system having an inlet for receiving material during each filling stroke, an outlet at which material is delivered to a pipeline during each pumping stroke, and a valve in the pipeline located downstream from the pump for preventing material flow through the pipeline when the valve is in a closed position, the method comprising:

closing the valve at an end of each pumping stroke to prevent material flow through the pipeline towards the pump;

sensing pressure of the material in the pipeline on an up stream side of the valve; and opening the valve during a subsequent pumping stroke when sufficient pressure exists in the pipeline on the up stream side of the valve to ensure that material will flow in a positive direction through the pipeline.

2. The method of claim 1 and further comprising:

sensing when, during pumping strokes of the pump, the valve opens to allow material flow through the pipeline after piston movement begins;

determining an output value based on when, during pumping strokes, the valve opens to allow material flow through the pipeline after piston movement begins; and providing an output signal as a function of the output value.

3. The method of claim 2 wherein the output value represents an actual volume of material delivered by the pump during a pumping stroke.

4. The method of claim 2 wherein the output value represents an accumulated volume of material delivered by the pump during a plurality of pumping cycles.

5. The method of claim 2 wherein the output value represents flow rate of sludge material delivered by the pump.

6. The method of claim 1 wherein the positive displacement piston/cylinder material pump and pipeline system also has a material storage piston/cylinder connected to the pipeline at a location downstream from the valve, the method further comprising:

drawing material from the pipeline into the material storage cylinder during the portion of each pumping stroke that the valve is open; and pumping material from the material storage cylinder into the pipeline during periods that the valve is closed.

7. A pump system for pumping a material, the pump system comprising:

a positive displacement piston/cylinder material pump for pumping material through a pump outlet during each pumping stroke;

a pipeline connected to the pump outlet for receiving material from the pump;

a valve in the pipeline located downstream from the pump for preventing material flow through the pipeline when the valve is in a closed position;

means for closing the valve at an end of a first pumping stroke to prevent material flow through the pipeline past the valve;

means for sensing pressure of the material on an upstream side of the valve;

means for determining when during a second pumping stroke the sensed pressure on the upstream side of the valve is sufficient to ensure that material will flow in a positive direction through the pipeline, the means for determining providing a first signal when the pressure is sufficient; and means for opening the valve in response to the first signal.

8. The pump system of claim 7 wherein the means for determining further comprises:

means for storing a first pressure value representative of the pressure on the upstream side of the valve at the end of the first pumping stroke;

means for comparing the sensed pressure on the upstream side of the valve during the second pumping stroke to the stored first pressure value; and means for providing the first signal when the sensed pressure on the upstream side of the valve during the second pumping stroke obtains a predetermined relationship to the stored first pressure value.

9. The pump system of claim 7 wherein the means for determining further comprises:

means for sensing pressure of the material on a downstream side of the valve during the second pumping stroke;

means for comparing the sensed pressure on the upstream side of the valve during the second pumping stroke to the sensed pressure on the downstream side of the valve during the second pumping stroke; and means for providing the first signal when the sensed pressure on the upstream side of the valve during the second pumping stroke obtains a predetermined relationship to the sensed pressure on the downstream side of the valve during the second pumping stroke.

10. A pump system for pumping a material, the pump system comprising:

a positive displacement pump which includes:

an inlet;

an outlet;

a first cylinder;

a first piston movable in the first cylinder;

first hydraulic drive means for moving the first piston reciprocatively through cycles which include a pumping stroke and a filling stroke; and first valve means for connecting the first cylinder to the outlet during pumping strokes and connecting the first cylinder to the inlet during filling strokes;

a first outlet pipe section connected to the outlet for receiving material from the positive displacement pump;

a second outlet pipe section connected to the first outlet pipe section for receiving material from the first outlet pipe section;

second valve means for selectively closing to prevent material flow between the first and second outlet pipe sections and selectively opening to allow material flow between the first and second outlet pipe sections;

means for sensing pressure of the material in the first outlet pipe section;

means for storing a first pressure value dependant upon the sensed pressure of the material in the first outlet pipe section at an end of a first pumping stroke;

means for closing the second valve means at the end of the first pumping stroke to prevent material flow between the first and second outlet pipe sections;

means for comparing the sensed pressure of the material in the first outlet pipe section during a second pumping stroke to the first pressure value; and means for opening the second valve means during the second pumping stroke when the pressure of the material in the first outlet pipe section and the first pressure value have a predetermined relationship.

11. The pump system of claim 10 wherein the system further comprises:

means for providing a first signal which indicates when during the second pumping stroke the second valve means opens.

12. The pump system of claim 11 and further comprising means for determining volume of material delivered at the outlet during the second pumping stroke based upon the first signal.

13. The pump system of claim 12 wherein the means for determining comprises:

means for measuring time intervals from a start of the second pumping stroke to an occurrence of the first signal and from the occurrence of the first signal to an end of the second pumping stroke; and means for calculating volume based upon the time intervals.

14. The pump system of claim 12 wherein the means for determining comprises:

means for sensing position of the first piston in the first cylinder when the first signal occurs; and means for calculating volume based upon the sensed position.

15. The pump system of claim 12 and further comprising:

means for measuring time during pumping strokes; and means for determining a volume flow rate as a function of the volume of material delivered at the outlet during a pumping stroke and the measured time.

16. The pump system of claim 12 and further comprising:

means for determining a total accumulated volume based upon the volumes determined during a plurality of pumping strokes.

17. The pump system of claim 16 and further comprising:

means for measuring time during the plurality of pumping strokes; and means for determining an average pumping rate as a function of the total accumulated volume and the measured time.

18. A pump system for pumping a material, the pump system comprising:

a positive displacement pump which includes:

an inlet;

an outlet;

a first cylinder;

a first piston movable in the first cylinder;

first hydraulic drive means for moving the first piston reciprocatively through cycles which include a pumping stroke and a filling stroke; and first valve means for connecting the first cylinder to the outlet during pumping strokes and connecting the first cylinder to the inlet during filling strokes;

a first outlet pipe section connected to the outlet for receiving material from the positive displacement pump;

a second outlet pipe section connected to the first outlet pipe section for receiving material from the first outlet pipe section;

second valve means for selectively closing to prevent material flow between the first and second outlet pipe sections and selectively opening to allow material flow between the first and second outlet pipe sections;

means for sensing pressure of the material in the first outlet pipe section;

means for sensing pressure of the material in the second outlet pipe section;

means for closing the second valve means at an end of a first pumping stroke to prevent material flow between the first and second outlet pipe sections;

means for comparing the sensed pressure of the material in the first outlet pipe section during a second pumping stroke to the sensed pressure of the material in the second outlet pipe section during the second pumping stroke; and means for opening the second valve means during the second pumping stroke when the pressure of the material in the first outlet pipe section and the pressure of the material in the second outlet pipe section have a predetermined relationship.

19. The pump system of claim 18 wherein the system further comprises:

means for providing a first signal which indicates when during the second pumping stroke the second valve means open.

20. The pump system of claim 19 and further comprising:

means for determining volume of material delivered at the outlet during the second pumping stroke based upon the first signal.

21. The pump system of claim 20 wherein the means for determining comprises:

means for measuring time intervals from a start of the second pumping stroke to an occurrence of the first signal and from the occurrence of the first signal to an end of the second pumping stroke; and means for calculating volume based upon the time intervals.

22. The pump system of claim 20 wherein the means for determining comprises:

means for sensing position of the first piston in the first cylinder when the first signal occurs; and means for calculating volume based upon the sensed position.

23. The pump system of claim 20 and further comprising:

means for measuring time during pumping strokes; and means for determining a volume flow rate as a function of the volume of material delivered at the outlet during a pumping stroke and the measured time.

24. The pump system of claim 20 and further comprising:

means for determining a total accumulated volume based upon the volumes determined during a plurality of pumping strokes.

25. The pump system of claim 24 and further comprising:

means for measuring time during the plurality of pumping strokes; and means for determining an average pumping rate as a function of the total accumulated volume and the measured time.

* * * * *